US005392849A

United States Patent [19]

Matsunaga et al.

[11] Patent Number: 5,392,849

[45] Date of Patent: Feb. 28, 1995

[54] LAYER-BUILT HEAT EXCHANGER

[75] Inventors: Tsuyoshi Matsunaga, Yasugun; Kenji Fujino, Nara; Takashi Sugahara; Hiroaki Kan, both of Otsu, all of Japan

[73] Assignee: Matsushita Refrigeration Company, Osaka, Japan

[21] Appl. No.: 200,365

[22] Filed: Feb. 23, 1994

Related U.S. Application Data

[63] Continuation of Ser. No. 859,376, Jun. 24, 1992, abandoned.

[30] Foreign Application Priority Data

| | | | |
|---|---|---|---|
| Sep. 28, 1990 | [JP] | Japan | 2-260992 |
| Oct. 26, 1990 | [JP] | Japan | 2-288725 |
| Apr. 5, 1991 | [JP] | Japan | 3-72871 |

[51] Int. Cl.[6] ..... F28F 3/08

[52] U.S. Cl. ..... 165/167; 165/78

[58] Field of Search ..... 165/167, 78, 166

[56] References Cited

U.S. PATENT DOCUMENTS

| | | | |
|---|---|---|---|
| 3,690,373 | 9/1972 | Wright | 165/167 |
| 3,733,244 | 5/1973 | Sanberger et al. | 165/166 |
| 4,258,784 | 3/1981 | Perry et al. | 165/166 |
| 4,503,908 | 3/1985 | Rosman et al. | 165/167 |
| 4,516,632 | 5/1985 | Swift et al. | 165/167 |
| 4,572,766 | 2/1986 | Dimitriou | 165/167 |
| 4,815,534 | 3/1989 | Fuerschbach | 165/167 |
| 4,966,231 | 10/1990 | Belcher et al. | 165/166 |
| 5,056,590 | 10/1991 | Bohn | 165/78 |
| 5,063,995 | 11/1991 | Förster et al. | 165/166 |

FOREIGN PATENT DOCUMENTS

| | | | |
|---|---|---|---|
| 812049 | 4/1937 | France . | |
| 885659 | 9/1943 | France . | |
| 1603631 | 6/1971 | France . | |
| 2184536 | 12/1973 | France . | |
| 143252 | 12/1915 | Germany | 165/166 |
| 47-34948 | 10/1972 | Japan . | |
| 55-3172 | 1/1980 | Japan . | |
| 71791 | 6/1981 | Japan | 165/166 |
| 57-196091 | 12/1982 | Japan . | |
| 60-66978 | 5/1985 | Japan . | |
| 61-55584 | 3/1986 | Japan . | |
| 61-122493 | 6/1986 | Japan . | |
| 61-122494 | 6/1986 | Japan . | |
| 62-037694 | 2/1987 | Japan . | |
| 213688 | 9/1987 | Japan | 165/167 |
| 63-30776 | 2/1988 | Japan . | |
| 14595 | 1/1989 | Japan | 165/166 |
| 2040496 | 2/1990 | Japan . | |
| 55121394 | 9/1990 | Japan . | |
| 798535 | 7/1958 | United Kingdom | 165/166 |
| 1131124 | 10/1968 | United Kingdom . | |
| 516894 | 6/1977 | U.S.S.R. | 165/167 |

*Primary Examiner*—Martin P. Schwadron
*Assistant Examiner*—L. R. Leo
*Attorney, Agent, or Firm*—Wenderoth, Lind & Ponack

[57] ABSTRACT

A layer-built heat exchanger has channels formed by dividers in a first-side plate 32 and a second-side plate 33. A seal plate 3 is interposed between the first- and second-side plates. The first-side plate 32 and second-side plate 33 are positioned relative to each other such that dividers 35 of the second-side plate 33 are in line with channels 36 of the first-side plate 32, an dividers 34 of the first-side plate 32 are in line with the channels 37 of the second-side plate 33, thus preventing deformation of the seal plate 3 due to a high differential pressure between the coolants flowing through the channels of the first- and second-side plates. The corners of the first-side plate 32, second-side plate 33, and seal plate 3 are also shaped differently so that omission of one of the component plates can be easily confirmed.

16 Claims, 13 Drawing Sheets

LAYER-BUILT HEAT EXCHANGER

This application is a continuation of now abandoned application, Ser. No. 07/859,376, filed Jun. 24, 1992.

FIELD OF THE INVENTION

The present invention relates to a layer-built heat exchanger for exchanging heat between a first coolant and a second coolant, and is used in a radiator for coolant oil in machine tools or in an air conditioner.

BACKGROUND OF THE INVENTION

Demand has risen for layer-built heat exchangers capable of using chlorofluorocarbons (CFC) and water and oil coolants in combination as first and second coolants for exchanging heat between CFC and CFC, CFC and water, water and water, or oil and water. A conventional layer-built heat exchanger is described below with reference to FIGS. 1–5 (Japanese Patent Laid-Open No. S61-243297).

As shown in the figures, the conventional layer-built heat exchanger 1 combines plural first-side plates 2, seal plates 3, and second-side plates 4 between end plates 5*a* and 5*b*. The inlet and outlet pipes 6–7 and 8–9 for the first and second coolants, respectively, are connected to the one end plate 5*b*.

The first-side plate 2 has a rectangular shape with a pair of round holes 10, provided offset from the center at each end of the plate, for the first coolant flow. A series of parallel and winding channels 11 are formed by dividers 12 for conducting the coolant from a position near the round hole 10 at one end of the first-side plate 2 to a position near the round hole 10 at the other end.

Holes 13 for the flow of the second coolant are formed on a diagonal line on the first-side plate 2 on the sides different from those on which the round holes 10 are formed. Each hole 13 has a rectangular shaped area 14 and a semi-circular shaped area 15 at the middle of the long side of the rectangular shaped area 14.

The second-side plate 4 has a similar rectangular shape with a series of parallel and winding channels 16 formed by dividers 17 to conduct the coolant between two round holes 18. These round holes 18 are formed corresponding to the holes 13 in the first-side plate 2, with part of each hole 18 tracing the same arc as the semi-circular shaped area 15 of the corresponding hole 13 in the first-side plate 2. Holes 19 are also provided corresponding to the round holes 10 in the first-side plate 2. Each hole 19 also consists of a rectangular shaped area 20 and a semi-circular shaped area 21 at the middle of the long side of the rectangular shaped area 20 such that part of each semi-circular shaped area 21 traces the same arc as the corresponding round hole 10 in the first-side plate 2.

The seal plate 3 has holes 22 and 23 similarly shaped to the corresponding holes 13 and 19 in the first- and second-side plates 2 and 4, respectively. The length of the rectangular shaped area 14 and 20 of the holes 13 and 19 are made long enough to cover the ends of each of the channels 11 and 16, respectively.

The plates are then assembled in successive layers in the order of first-side plate 2, seal plate 3, second-side plate 4, seal plate 3, first-side plate 2, seal plate 3, . . . as shown in the figure, and are sealed between the seal end plate 5*a* on one end and the end plate 5*b* provided with the first and second coolant inlet/outlet pipes 6–7 and 8–9.

With this construction the first coolant flows in through the inlet pipe 6, is diffused to the channels 11 of the first-side plate 2 in the rectangular shaped area of the hole 22 in the seal plate 3, and flows through the channels 11 to the hole 22 on the opposite side to flow out from the outlet pipe 7. Similarly, the second coolant flows in through the inlet pipe 8, is diffused to the channels 16 of the second-side plate 4 in the rectangular shaped area of the hole 19 in the seal plate 3, and flows out through the hole 19 on the opposite side to the outlet pipe 8.

Heat is exchanged between the first and second coolants through the seal plate 3, which is made from a material with good thermal conductivity for greater heat exchange efficiency.

With this construction, however, the distance from the ends of the channels 11 or 16 to the center of the hole 10 or 18 is long, because the channels 11 or 16 of the first-side plate 2 or second-side plate 4 are the same length and the ends of the channels form a line with respect to the hole 10 or 18. The first or second coolant must therefore travel a greater distance before it enters the channels, and coolant flow is impeded by this increased distance.

Also, when there is a pressure difference between the first and second coolants, the seal plate 3 tends to become deformed where the channels 11 of the first-side plate 2 and the channels 16 of second-side plate 4 are positioned one over the other through the seal plate 3, because the seal plate 3 is the only member separating the channels 11 and 16 of the first- and second-side plates 2 and 4. This deformation also interferes with the coolant flow. It is therefore necessary to increase the thickness H of the seal plate 3 to prevent this deformation. The overall size and cost of the heat exchanger therefore increase.

In addition, if the order of the plates is mistaken during assembly, and the seal plate 3 is omitted, leakage of the first and second coolants may occur, the offset in plate position makes assembly more difficult, and both productivity and quality decline.

In addition, to assemble the inlet/outlet pipes 6, 7, 8, and 9 to the end plate 5*b*, holes in the end plate 5*b* must be countersunk so that the inlet/outlet pipes 6, 7, 8 and 9 can be positioned.

Therefore, an object of the present invention is to provide a layer-built heat exchanger for shortening the distance between the inlet/outlet holes and channel ends in the first-side plate and the second-side plate, thus reducing the flow resistance.

A further object is to provide a layer-built heat exchanger wherein there is minimal parallel overlap between the channels of the first-side plate and the second-side plate through the seal plate.

A further object is to provide a layer-built heat exchanger wherein there is no error in the assembly order of the first-side plate, seal plate, and the second-side plate.

A further object is to provide a layer-built heat exchanger whereby positioning of the inlet/outlet pipes to the end plate is simplified.

SUMMARY OF THE INVENTION

A layer-built heat exchanger according to the present invention comprises channels in the first- and second-side plates of different lengths such that the ends of the channels form a V-shape with an approximately equal distance between the end of each channel and the hole.

Furthermore, the channels of the second-side plate are positioned over the dividers forming the channels of the first-side plate, and the channels of the first-side plate are positioned over the dividers forming the channels of the second-side plate. This prevents deformation of the seal plate between the first-side plate and the second-side plate.

Furthermore, a convex member that has a height less than the plate thickness is formed on two different sides of the first-side plate and the second-side platel, and concave portions are formed in the seal plate at a position to mate with the convex members of the first- and second-side plates. Omission of the seal plate during assembly is thus less likely to be forgotten.

Furthermore, by shaping the corners of the first-side plate, second-side plate, and seal plate differently, a simple visual inspection can confirmwhether or not the plates are assembled in the correct order.

In addition, the diameter of the holes in the first-side plate or the second-side plate is smaller than the diameter of the holes to which the inlet/outlet pipes are inserted in the end plates, thus controlling the depth to which the inlet/outlet pipes can be inserted.

Furthermore, the inlet/outlet pipes are inserted from one end plate to the other, and a hole is provided at the position of the round holes in the first-side plate, second-side plate, and seal plate to control the depth of inlet/outlet pipe insertion.

DESCRIPTION OF THE PREFERRED EMBODIMENTS

Figure 1:
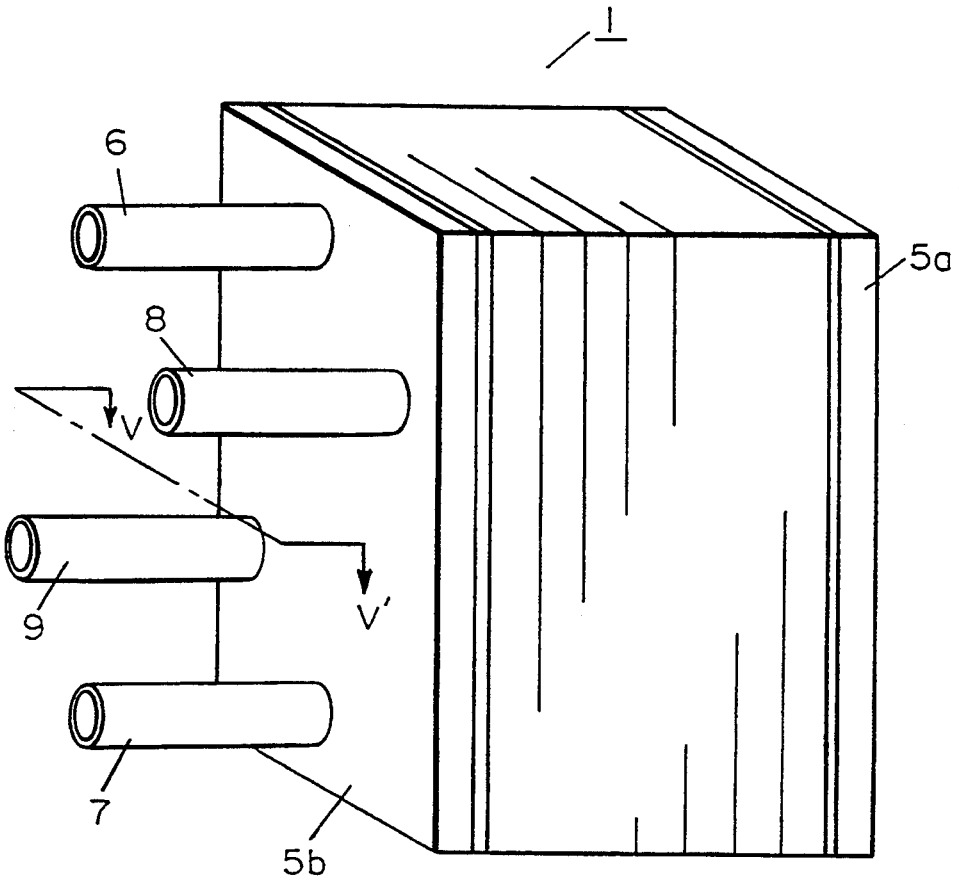
FIG. 1 PRIOR ART
FIG. 1 is an oblique view of a conventional layer-built heat exchanger.
Figure 4:
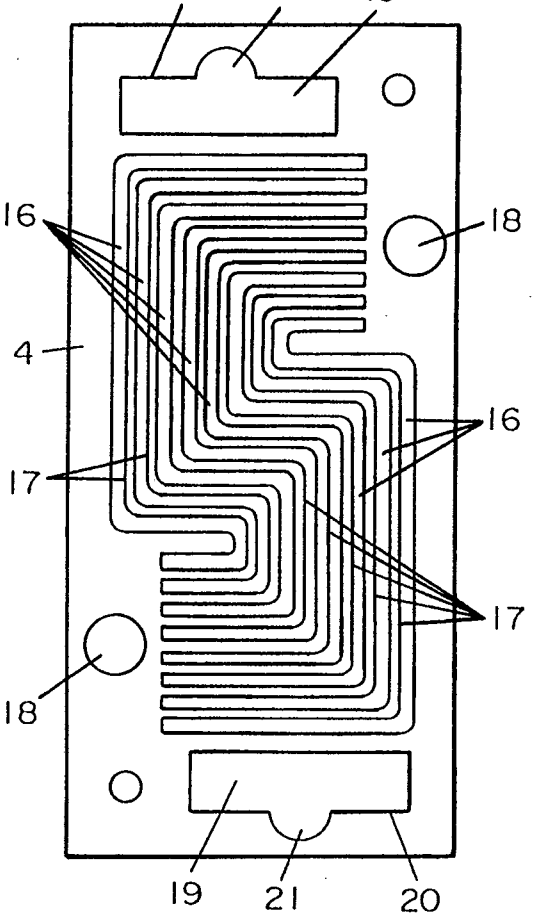
FIG. 4 PRIOR ART
FIG. 4 is a plan view of a second-side plate in FIG. 1.
Figure 3:
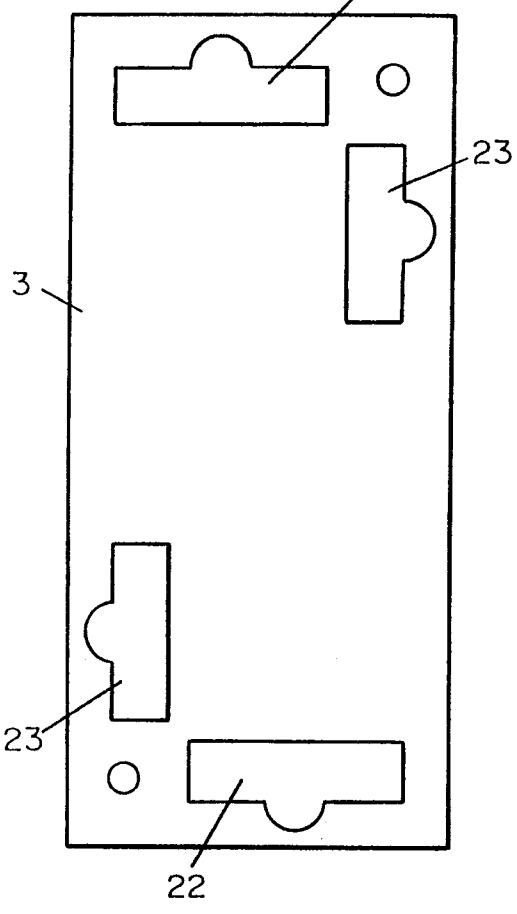
FIG. 3 PRIOR ART
FIG. 3 is a plan view of a seal plate in FIG. 1.
Figure 2:
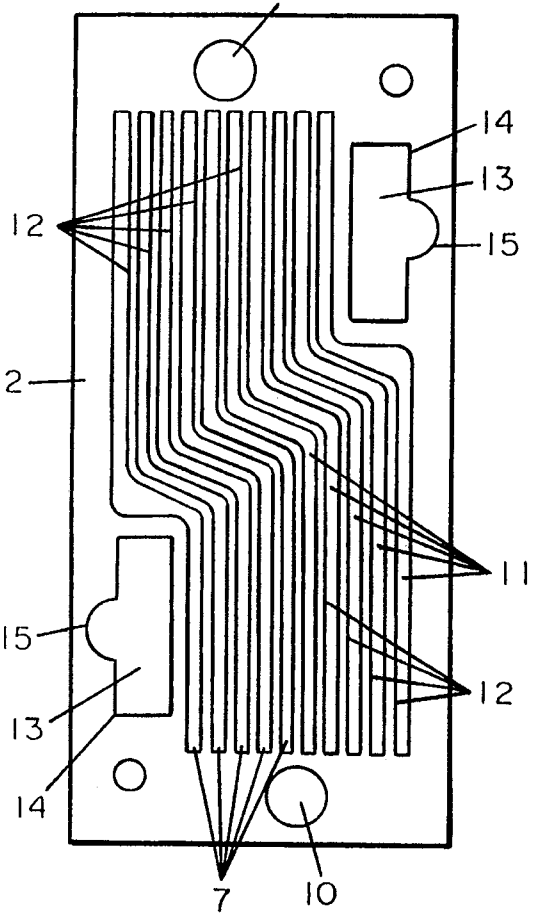
FIG. 2 PRIOR ART
FIG. 2 is a plan view of a first-side plate in FIG. 1.
Figure 5:
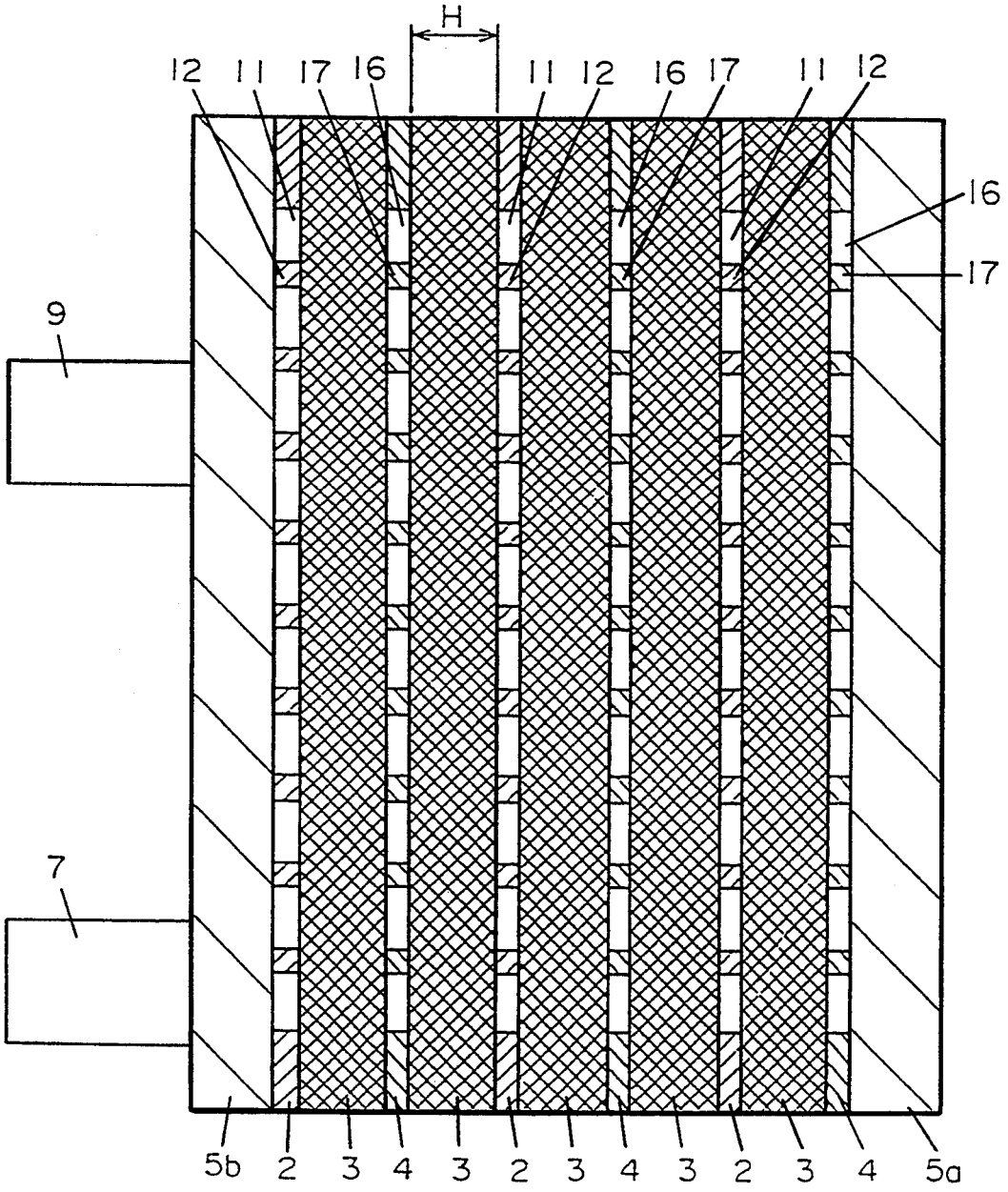
FIG. 5 PRIOR ART
FIG. 5 is a cross sectional view taken along line V—V in FIG. 1.
Figure 6:
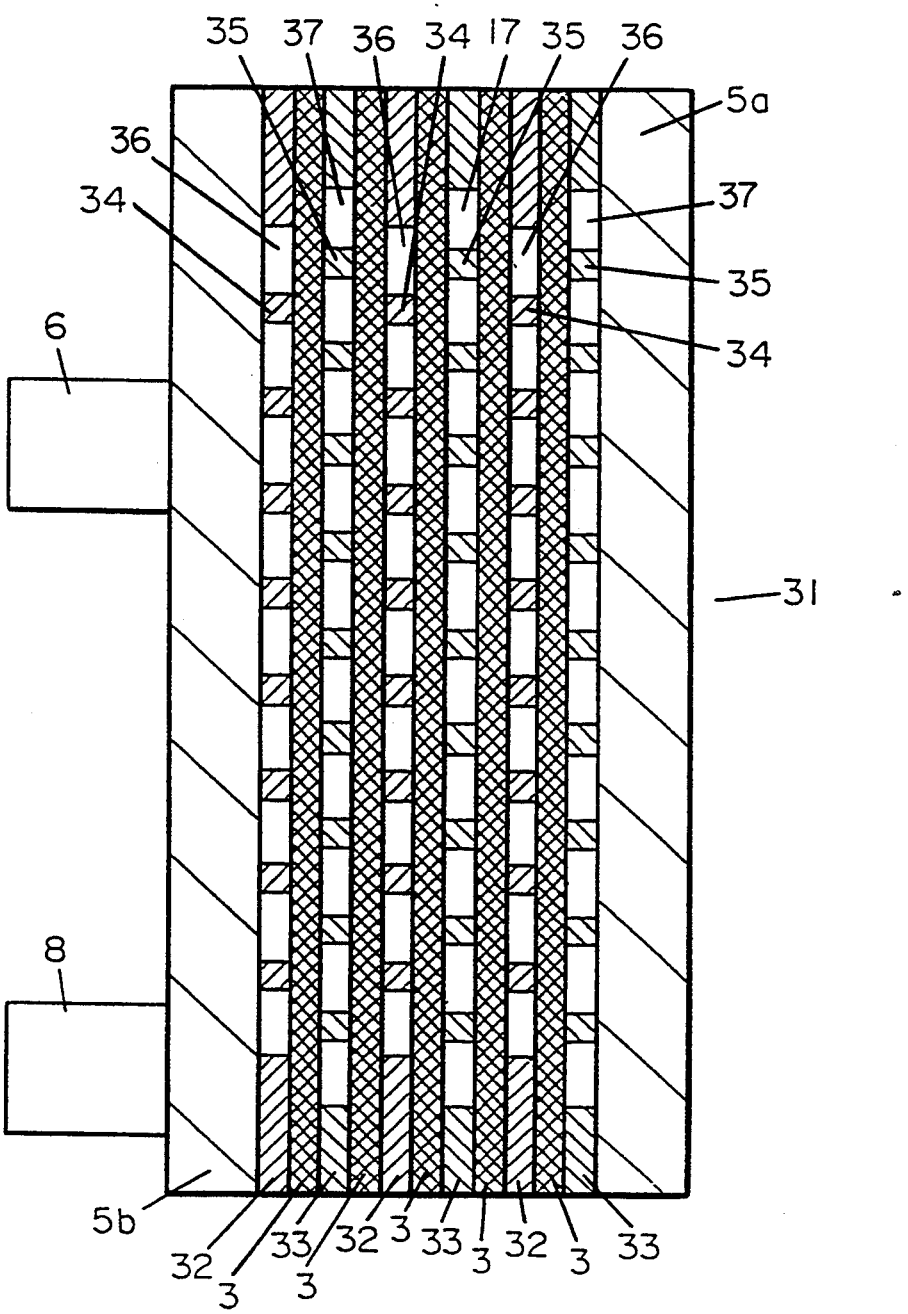
FIG. 6 is a cross sectional view corresponding to FIG. 5 for a layer-built heat exchanger according to one embodiment of the present invention.
Figure 9:
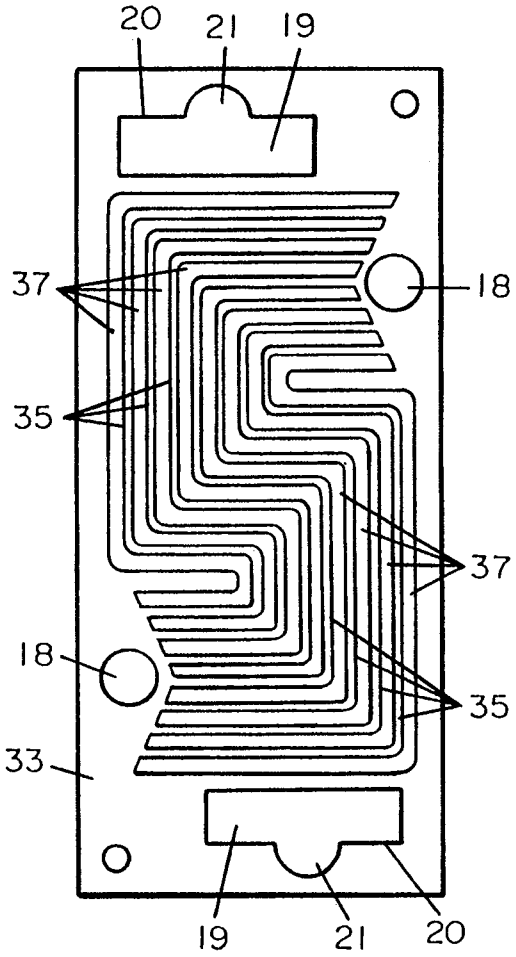
FIG. 9 is a plan view of a second-side plate in FIG. 6.
Figure 8:
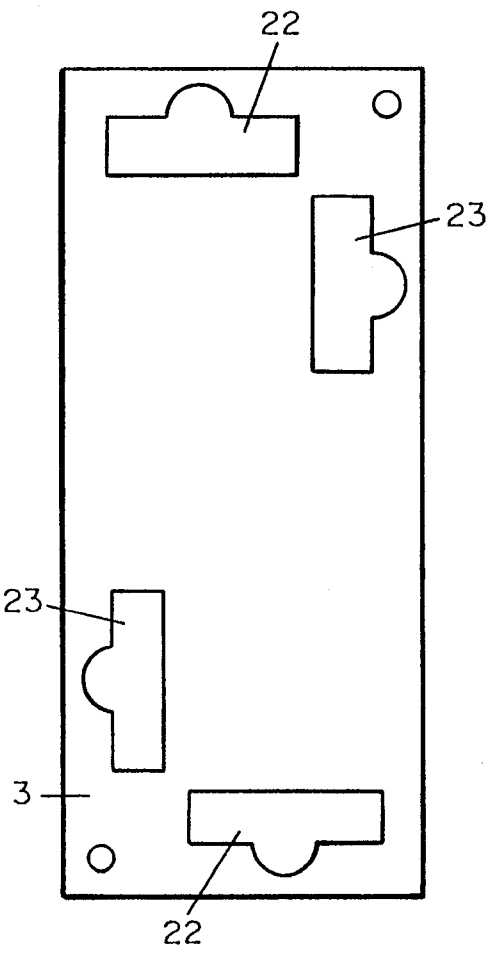
FIG. 8 is a plan view of a seal plate in FIG. 6.
Figure 7:
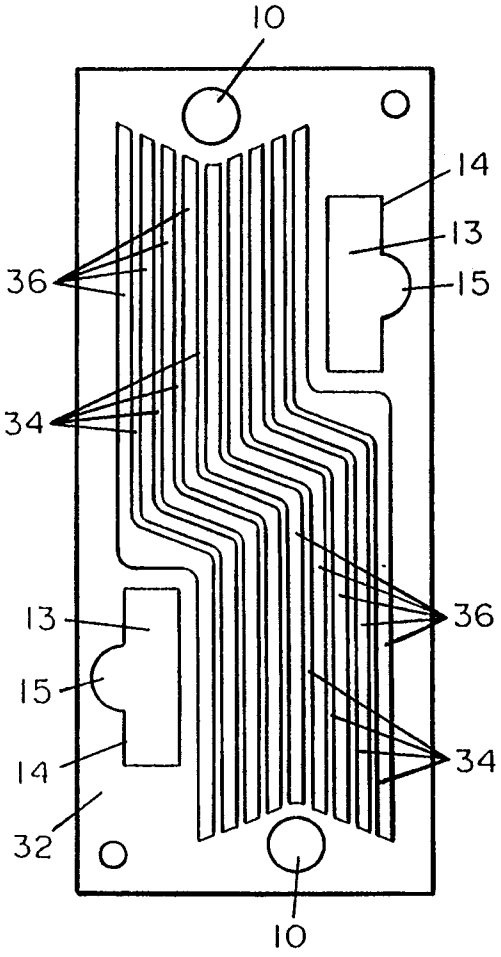
FIG. 7 is a plan view of a first-side plate in FIG. 6.
Figure 10:
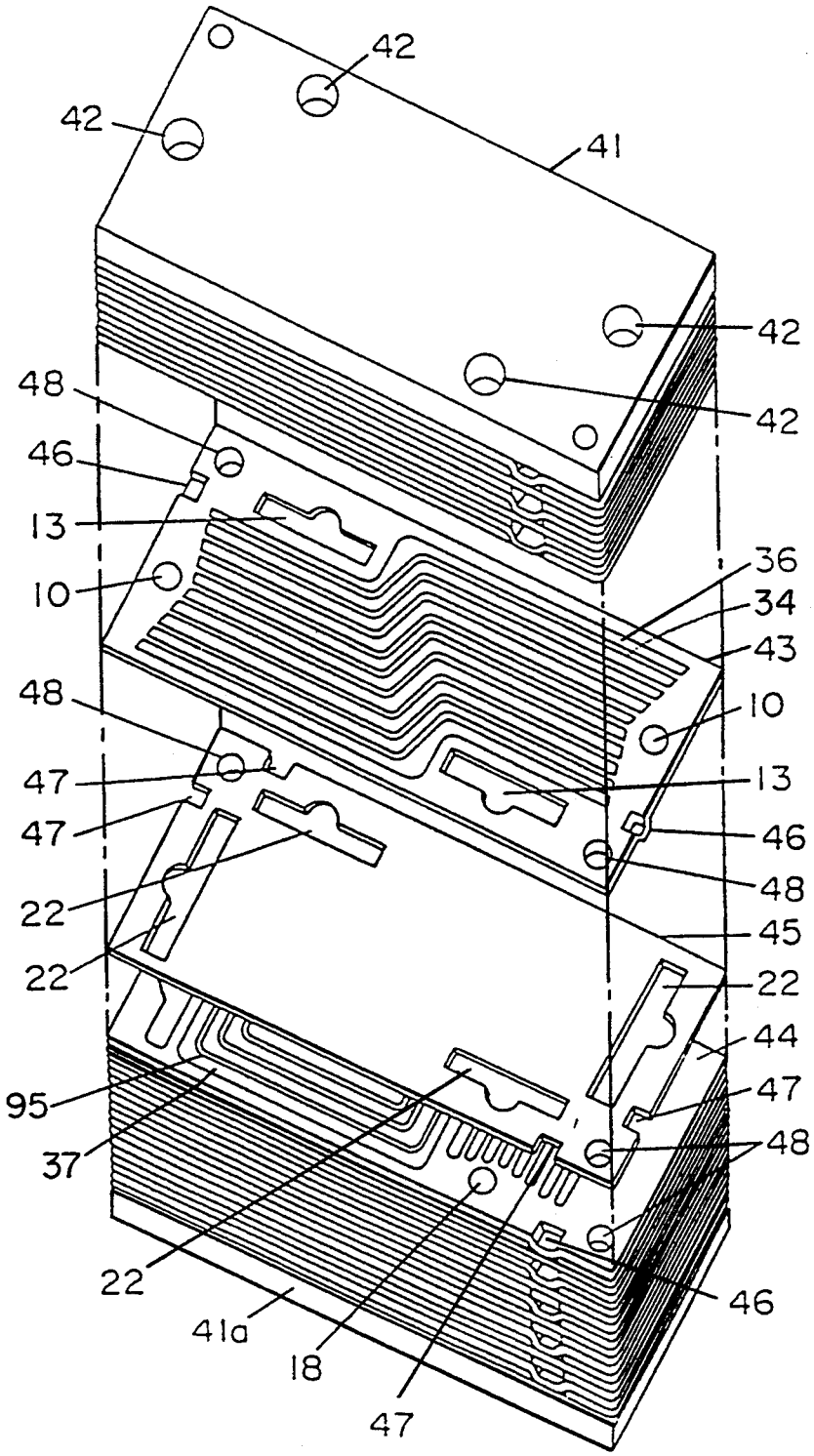
FIG. 10 is an oblique exploded view of a layer-built heat exchanger according to another embodiment of the present invention.
Figure 11:
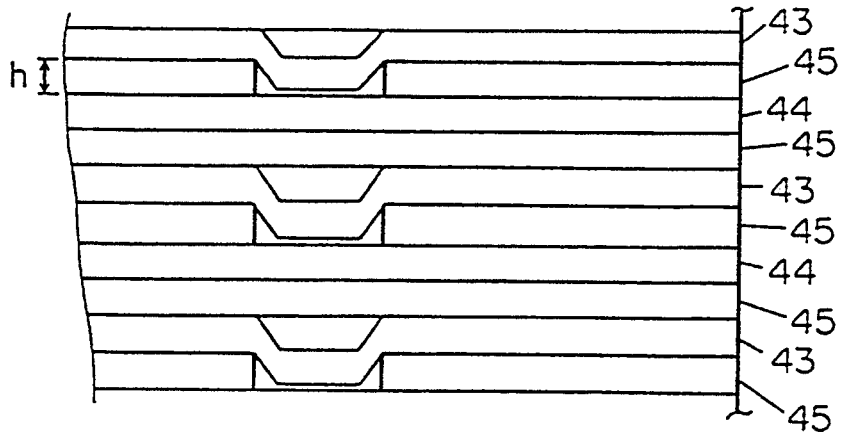
FIG. 11 is a side view of FIG. 10.
Figure 12:
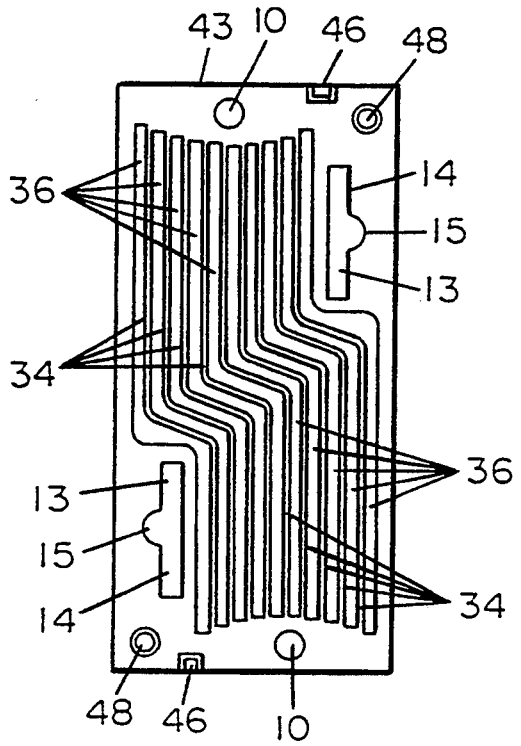
FIG. 12 is a plan view of a first-side plate in FIG. 10.
Figure 13:
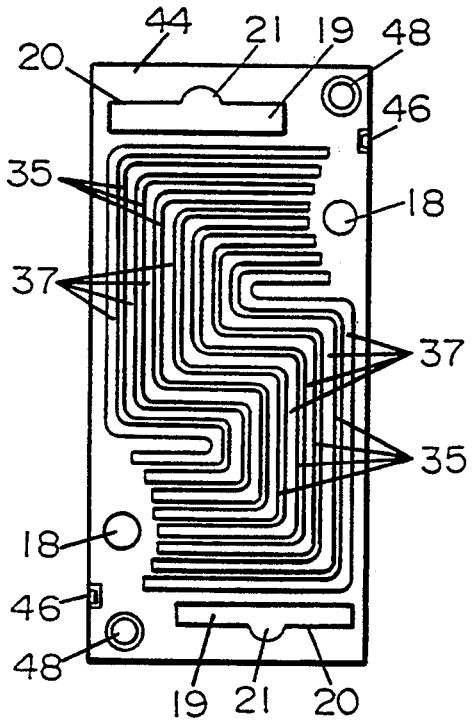
FIG. 13 is a plan view of a seal plate in FIG. 10.
Figure 14:
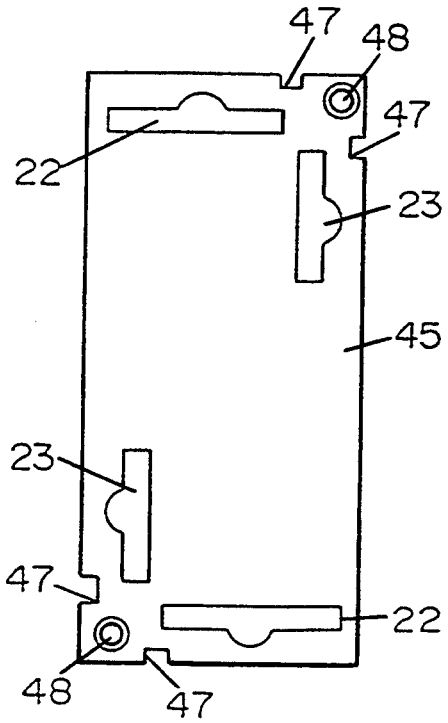
FIG. 14 is a plan view of a second-side plate in FIG. 10.
Figure 17:
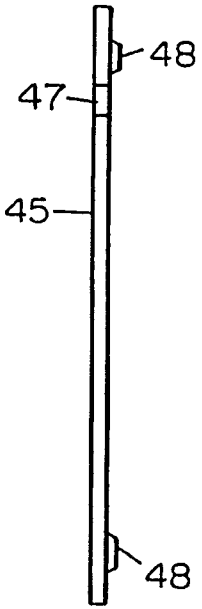
FIG. 17 is a side view of FIG. 14.
Figure 16:
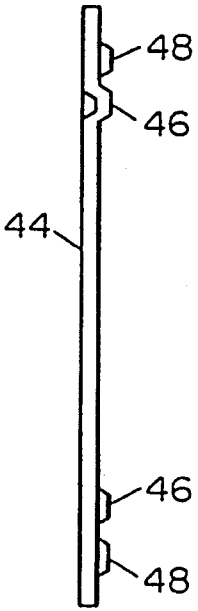
FIG. 16 is a side view of FIG. 13.
Figure 15:
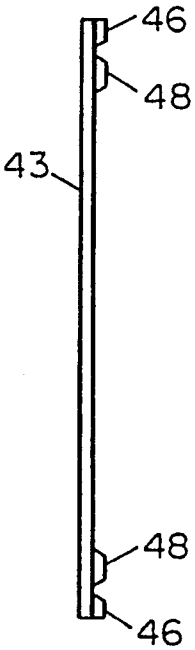
FIG. 15 is a side view of FIG. 12.
Figure 18:
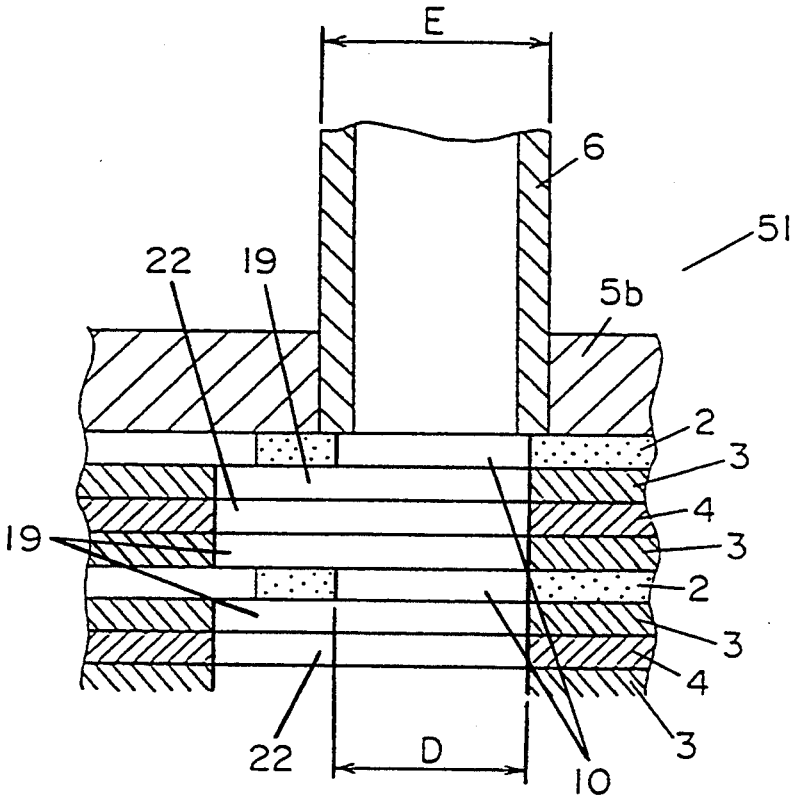
FIG. 18 is a partial cross sectional view of the major components of a layer-built heat exchanger according to yet another embodiment of the present invention.
Figure 19:
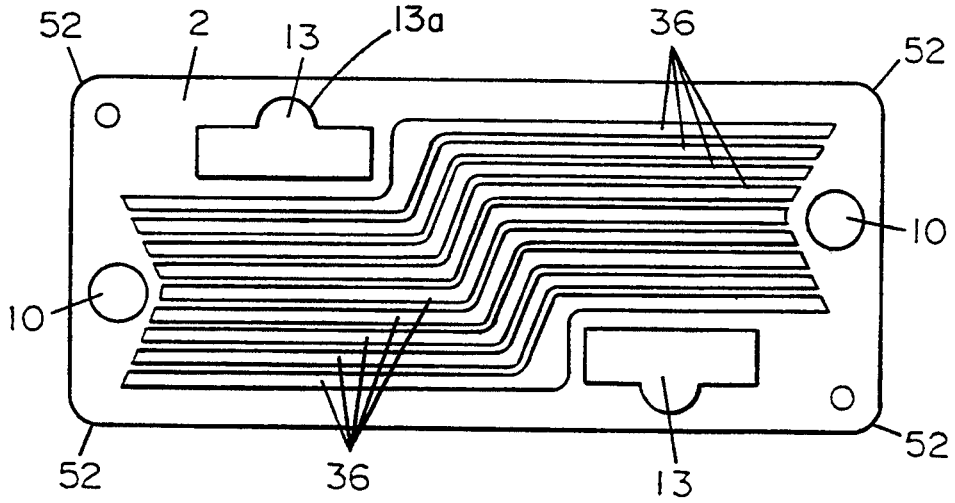
FIG. 19 is a plan view of a first-side plate in FIG. 18.
Figure 20:
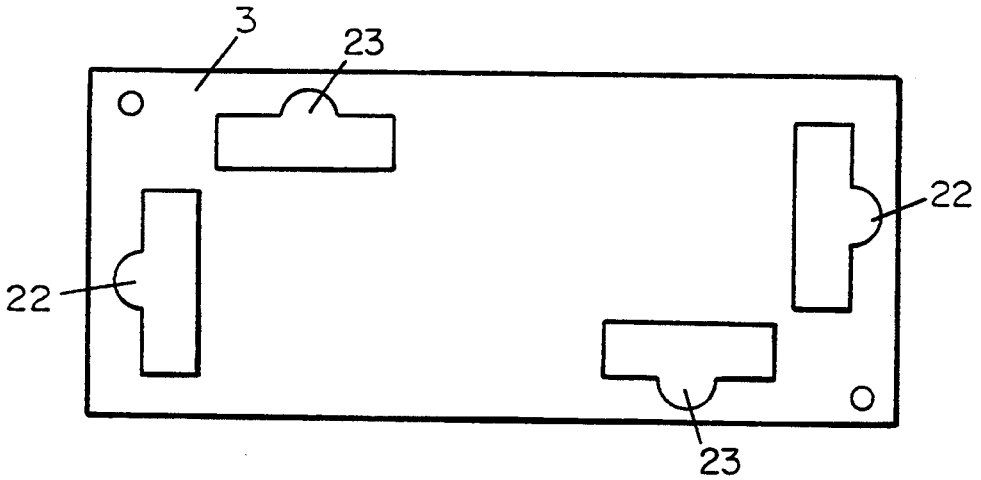
FIG. 20 is a plan view of a seal plate in FIG. 18.
Figure 21:
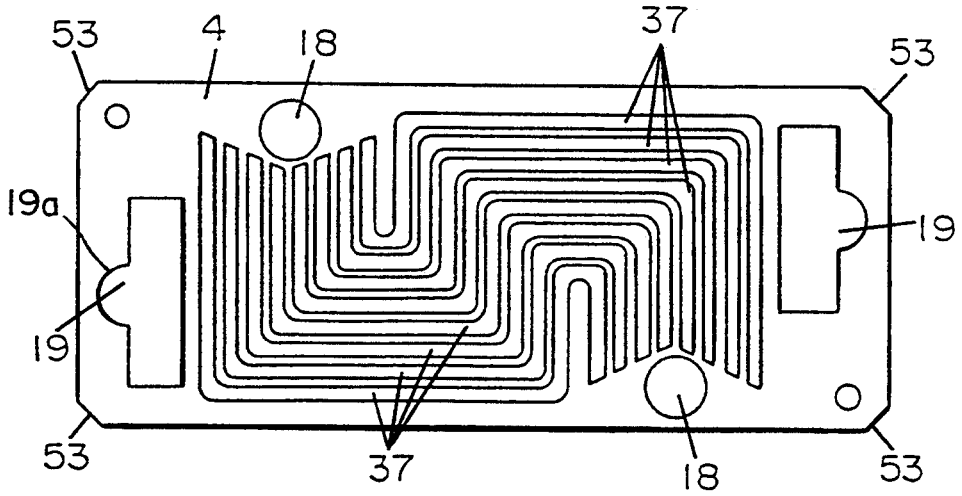
FIG. 21 is a plan view of a second-side plate in FIG. 18.

The preferred embodiments of the present invention are described below with reference to the accompanying FIGS. 6–9. It is to be noted that like parts in the preferred embodiments and the prior art described above are referred to by like reference numbers, and further description of said like parts is omitted hereinbelow.

As shown in the figures, a layer-built heat exchanger 31 according to the present invention is an assembly of plural first-side plates 32, seal plates 3, and second-side plates 33 assembled in alternating layers and sealed between a first end plate 5*a* and a second end plate 5*b*, which comprises inlet/outlet pipes 6 and 8, so that the fluid can flow through the first-side plate 32 and the second-side plate 33 without leaking.

The first coolant flowing in from the inlet pipe 6 flows into the plural channels 36, divided by the dividers 34, in the first-side plate 32, and flows out from the outlet pipe 7. Similarly, the second coolant flowing in from the inlet pipe (not shown) flows into the plural channels 37, divided by dividers 35, in the second-side plate 33, and flows out from the outlet pipe (not shown). Heat is exchanged through the seal plate 3 between the two different fluids flowing through the upper and lower plates.

Because the channels 37 of the second-side plate 33 are formed over the dividers 34 of the first-side plate 32, and the channels 36 of the first-side plate 32 are formed over the dividers 35 of the second-side plate 33, two seal plates 3 and the divider 34 of one second-side plate 33 or the divider 35 of one first-side plate 32 are positioned between any two channels 36 or channels 37. The thickness of the solid material located between the channels 36 or 37 becomes great so as to prevent deformation of the seal plate 3, even when there is a high differential pressure between the first and second coolants. Thus, the coolant flow can be maintained.

An alternative embodiment of the invention is described below with reference to FIGS. 10–17. In this embodiment, 41 is an end plate comprising plural inlet/-outlet members 42, 41*a* is another end plate to seal the coolant, 43 is a first-side plate comprising channels 36 formed with dividers 34, 44 is a second-side plate comprising channels 37 formed with dividers 35, and 45 is a seal plate. Plural convex members 46 that are shallower than the plate thickness h are formed on two different sides of the first-side plate 43 and the second-side plate 44, and concave portions 47 are formed in the seal plate 45 at a position to mate with the convex members 46 of the first- and second-side plates. Thus, the first-side plate 43 and the second-side plate 44 mate with the seal plate 45 during assembly, and if the seal plate 45 is forgotten and not inserted during manufacture, a gap is formed between the first-side plate 43 and the second-side plate 44 by the convex members 46, having a height less than the plate thickness h, formed on two different sides of the first- and second-side plates 43 and 44. Thus, the the mistake can be easily discovered by visual inspection.

Furthermore, by providing holes 48 with a raised rib edge, the holes 48 overlap one another when assembled, and positioning during assembly is made easier. In addition, the ribbed edges prevent the plates from slipping out of position.

Yet another embodiment of the invention is described below with reference to FIGS. 18–21. Like parts in the preferred embodiments and the prior art described above are referred to by like reference numbers, and further description of said like parts is omitted hereinbelow.

A layer-built heat exchanger 51 according to this embodiment is an assembly of plural first-side plates 2, seal plates 3, and second-side plates 4 alternately placed one over the other in the above order, and the assembled layers are sealed between a first end plate (not shown) and a second end plate 5*b*, which end plate 5*b* comprises an inlet pipe 6 and an outlet pipe (not shown). The layers are bonded together by adhesive material or wax so that the fluid can flow through the first-side plate 2 and the second-side plate 4 without leaking.

With this construction, the first coolant flows in through the inlet pipe 6, is guided along the holes 10, 22, and 19 and flows through the channels 36 of the first-side plate 2 to the holes 10, 22, and 19, on the opposite side to flow out from the outlet pipe (not shown). Similarly, the second coolant flows in through the inlet pipe (not shown), is guided along the holes 13, 23, and 18 and flows through the channels 37 of the second-side plate 4, and flows out through the holes 13, 23, and 18 on the opposite side to the outlet pipe (not 10 shown). Heat is exchanged between the first and second coolants through the seal plate 3 as the coolants flow through the respective plates.

In this embodiment the diameter D of the holes 10 in the plates following the end plate 5*b* in the assembly, i.e.,. the first-side plate 2 or the second-side plate 4, is made smaller than the outside diameter E of the inlet/-outlet pipes 6 and 7, and at the same time, the diameter of the semi-circular member 15 of the first-side plate 2 opposite the inlet/outlet pipes 8 and 9 is made smaller than the diameter of the of the inlet/outlet pipes 8 and 9. By this arrangement, the inlet pipe 6 and the outlet pipe (not shown) stop where they contact the first-side plate 2, and are correctly positioned without countersinking the end plate 8.

Furthermore, because the corners of the first-side plate 2 are rounded in an arc 52 and the corners of the second-side plate 4 are bevelled on an angle 53, the type of plate can be determined by visual inspection after plate assembly to easily determine whether or not the plates are assembled in the correct order.

Figure 22:
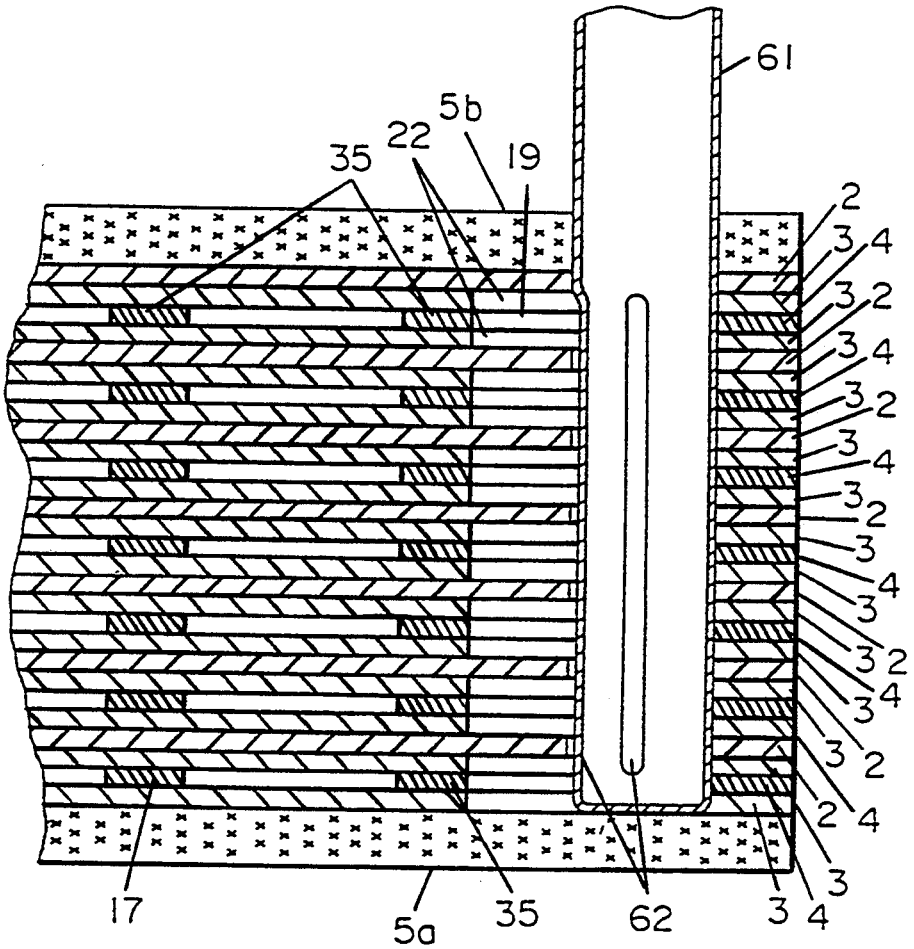
FIG. 22 is a cross sectional view of a layer-built heat exchanger according to a further embodiment of the present invention.

A further embodiment of the invention is described below with reference to FIG. 22. Like parts in the preferred embodiments and the prior art described above are referred to by like reference numbers, and further description of the like parts is omitted hereinbelow.

In this embodiment the inlet pipe 61 for the first coolant passes through the end plate 5*b*, the round holes 10 in the first-side plates 2, the holes 22 in the seal plates 3, and the holes 19 in the second-side plates 4 to the other end plate 5*a*. A slit hole 62 is formed in the inlet pipe 61 at the position corresponding to the holes 10, 22, and 19. The outlet pipe for the first coolant and the inlet/outlet pipes for the second coolant are similarly formed through each of the plates to the end plate 5*a*.

It is thus possible during assembly to simply insert the inlet/outlet pipes through the holes to the opposite end plate to simply and correctly position the inlet/outlet pipes in the layer-built heat exchanger.

In these embodiments plural parallel channels 36 extending in a winding manner from a position adjacent one round hole 10 in the first-side plate 32 to a position adjacent the other round hole 10 are formed by plural dividers 36. The length of each channel 36 increases as the distance of the channel 36 from the center of the hole 10 increases, so that the ends of the channels 36 form an approximate V-shape around the center of the round hole 10 with the end of each channel 36 as close as possible to the center of the round hole 10. In addition, plural parallel channels 37 winding from a position adjacent one round hole 18 in the second-side plate 33 to a position adjacent the other round hole 18 are formed by plural dividers 35. The length of each channel 37 increases as the distance of the channel 37 from the center of the hole 18 increases, so that the ends of the channels 37 form an approximate V-shape around the center of the around hole 18 with the end of each channel 37 as close as possible to the center of the round hole 18. The average distance between the end of the channels 36 and 37 and the holes 10 and 18 is therefore shortened, improving the flow and distribution of coolant into the channels 36 and 37.

It should be further noted that when the first-side plates 32 and second-side plates 33 are stacked with the seal plates 3 therebetween, buffer chambers are formed over the holes 10 of the first-side plates 32 and 18 of the second-side plates 33. That is, for example, when a plate 3 and a plate 33 are stacked on top of each other, the holes 22 and 19 thereof form a chamber that will be adjacent to the hole 10 of the adjacent first-side plate 32. Note in particular FIG. 18, which clearly illustrates the formation of the buffer chambers. Thus, as the ends of the channels 36 and 37 form the V-shape around the center of their respective holes 10 and 18, they progressively intrude further into the buffer chambers formed about the holes 10 and 18. Note, of course, that the buffer chambers are formed by the holes that are larger than the holes 10 and 18.

Because the channels 37 of the second-side plate 33 are formed over the dividers 34 of the first-side plate 32, and the channels 36 of the first-side plate 32 are formed over the dividers 35 of the second-side plate 33, two seal plates 3 and one second-side plate 33 divider 34, or first-side plate 32 divider 35, are positioned between any two channels 37 or channels 36. The greater total seal plate 3 thickness between the channels 37 or 36 therefore prevents deformation of the seal plate 3 even when there is a high differential pressure between the first and second coolants, and the coolant flow can thus be maintained.

A layer-built heat exchanger according to the present invention is suited to exchanging heat between the first and second coolants of an air conditioner. It is also suited for exchanging heat from working oil in machine tools and other machineryby circulation with another coolant such as water.

What is claimed is:

1. An arrangement in a layer-built heat exchanger, comprising:

a first plurality of plates each comprising a first flat rectangular panel having a plurality of first channels therein defined and separated by a plurality of first dividers for the flow of a first heat exchange fluid through said first channels, a pair of first holes through said first flat rectangular panel for the flow of the first heat exchange fluid located at opposite ends of said first channels, and a pair of second holes through said first flat rectangular panel for the flow a second heat exchange fluid;

a plurality of second plates each comprising a second flat rectangular panel having a plurality of second channels therein defined and separated by a plurality of second dividers for the flow of a second heat exchange fluid through said second channels, a pair of first holes through said second flat rectangular panel aligned with said first holes of said first plates for the flow of the first heat exchange fluid therethrough, and a pair of second holes through said second flat rectangular panel aligned with said second holes of said first plates for the flow of the second heat exchange fluid therethrough, said second holes of said second plates being located at opposite ends of said second channels, said second holes of said first plates being larger than said second holes of said second plates, and said first holes of said second plates being larger than said first holes of said first plates; and a plurality of seal plates disposed between said first plates and said second plates, said seal plates having a pair of first holes therethrough aligned with said first holes of said first and second plates for the flow of the first heat exchange fluid, and a pair of second holes therethrough aligned with said second holes of said first and second plates, said first holes and said second holes of said seal plates having substantially the same configuration as said first holes of said second plates and said second holes of said first plates, respectively, wherein said first plates and said second plates alternate with said seal plates disposed between said first and second plates so as to isolate said first and second plates from each other, wherein said first holes of said seal plates and said first holes of said second plates are located over said first holes of said first plates so as to define first buffer chambers over said first holes of said first plates, and said second holes of said first plates and said second holes of said seal plates are located over said second holes of said second plates to define second buffer chambers over said second holes of said second plates;

wherein said ends of said first channels and said ends of said second channels of said first and second plates substantially define a V-shape about said first and second holes, respectively intruding into said first and second buffer chambers, and are located such that the length of said first and second channels in said first and second buffer chambers increases with an increase in the distance of said channels from the center of their respective said hole.

2. The arrangement of claim 1, wherein at each said end of said first and second channels, said channels overlap, in a direction perpendicular to said flat rectangular panels, the respective said first and second holes of each said seal plate aligned with the respective said hole of each said end of said channels, said channels increasing in the amount of overlap with the respective said hole of said seal plate with the increase in the distance of said channels from the center of their respective said hole.

3. The arrangement of claim 2, wherein said first holes of said first plates and said second holes of said second plates are each circular, and said first and second holes of said seal plates each comprise a rectangular portion overlapped by a said end of said channels and a semi-circular portion aligned with one of said first and second holes of said first and second plates.

4. The arrangement of claim 1, wherein, in a direction perpendicular to the plane of said first and second flat rectangular panels, at least a portion of said second dividers are positioned opposite to said first channels and at least a portion of said first dividers are positioned opposite said second channels.

5. The arrangement of claim 4, wherein said first and second channels and said first and second dividers extend parallel to each other at said portions of said second and first dividers extending opposite to said first and second channels.

6. The arrangement of claim 1, wherein said first plates, said second plates and seal plates are each provided with a different identifying shape at outside edges thereof.

7. The arrangement of claim 6, wherein said identifying shape of end said first plate is a convex member on one side thereof, said identifying member of each said second plate is a convex member on a side thereof and said identifying member of each seal plate comprises concave portions for receiving said convex portions of said first and second plates.

8. The arrangement of claim 6, wherein said identifying shape of each said first plate comprises rounded corners on said first flat rectangular panel, said identifying shape on each second plate comprises beveled corners on said second flat rectangular panel and said identifying shape on each said seal plate comprises corners shaped differently than said corners of said first and second flat rectangular panels.

9. The arrangement of claim 1, wherein opposite end plates are provided having said first and second plates and said seal plates therebetween, one of said end plates being provided with inlet and outlet pipes for the first and second heat exchange fluids communicating with said pairs of first and second holes.

10. The arrangement of claim 9, wherein said holes of said pairs of first and second holes of each said first plate have a smaller diameter than the outer diameter of the respective said inlet and outlet pipes.

11. The arrangement of claim 10, wherein said inlet and outlet pipes extend through the one said end plate and abut against one said first plate.

12. An arrangement in a layer-built heat exchanger, comprising:

a first plate comprising a first flat rectangular panel having a plurality of first channels therein defined and separated by a plurality of first dividers for the flow of a first heat exchange fluid through said first channels, a pair of first holes through said first flat rectangular panel for the flow of the first heat exchange fluid, said first holes being located at opposite ends of said first channels, and a pair of second holes through said first flat rectangular panel for the flow a second heat exchange fluid;

a second plate comprising a second flat rectangular panel having a plurality of second channels therein defined and separated by a plurality of second dividers for the flow of a second heat exchange fluid through said second channels, a pair of first holes through said second flat rectangular panel aligned with said first holes of said first plate for the flow of the first heat exchange fluid therethrough, and a pair of second holes through said second flat rectangular panel aligned with said second holes of said first plate for the flow of the second heat exchange fluid therethrough, said second holes being located at opposite ends of said second channels;

a seal plate disposed between said first plate and said second plate, said seal plate having a pair of first holes therethrough aligned with said first holes of said first and second plates for the flow of the first heat exchange fluid, and a pair of second holes therethrough aligned with said second holes of said first and second plates; and opposite end plates having said first and second plates and said seal plate therebetween, one of said end plates having inlet and outlet pipes for the first and second heat exchange fluids communicating with said pairs of first and second holes, said inlet and outlet pipes extending through the respective said holes of said first and second plates and said seal plate to the other said end plate, and said inlet and outlet pipes each having an elongated hole therein extending between said end plates in said holes of said first and second plates and said seal plate.

13. An arrangement in a layer-built heat exchanger, comprising:

a first plurality of plates each comprising a first flat rectangular panel having a plurality of first channels therein defined and separated by a plurality of first dividers for the flow of a first heat exchange fluid through said first channels, a pair of first holes through said first flat rectangular panel for the flow of the first heat exchange fluid located at opposite ends of said first channels, and a pair of second holes through said first flat rectangular panel for the flow a second heat exchange fluid;

a plurality of second plates each comprising a second flat rectangular panel having a plurality of second channels therein defined and separated by a plurality of second dividers for the flow of a second heat exchange fluid through said second channels, a pair of first holes through said second flat rectangular panel aligned with said first holes of said first plates for the flow of the first heat exchange fluid therethrough, and a pair of second holes through said second flat rectangular panel aligned with said second holes of said first pleates for the flow of the second heat exchange fluid therethrough, said second holes of said second plates being located at opposite ends of said second channels, said second holes ofd said first plates being larger than said second holes of said second plates, and said first holes of said second plates being larger than said first holes of said first plates; and a plurality of seal plates disposed between said first plates and said second plates, said seal plates having a pair of first holes therethrough aligned with said first holes of said first and second plates for the flow of the first heat exchange fluid, and a pair of second holes therethrough aligned with said second holes of said first and second plates, said first holes and said second holes of said seal plates having substantially the same configuration as said first holes of said second plates and said second holes of said first plates, respectively, wherein said first plates and said second plates alternate with said seal plates disposed between said first and second plates so as to isolate said first and second plates from each other, wherein said first holes of said seal plates and said first holes of said second plates are located over said first holes of said first plates so as to define first buffer chambers over said first holes of the first plates, and said second holes of said first plates and said second holes of said seal plates are located over said second holes of said second plates to define second buffer chambers over said second holes of said second plates;

wherein said ends of said first channels and said ends of said second channels of said first and second plates intrude into said first and second buffer chambers, and are located such that the length of said channels increases in said first and second buffer chambers with an increase in the distance of said channels from the center of their respective said hole.

14. The arrangement of claim 13, wherein at each said end of said first and second channels, said channels overlap, in a direction perpendicular to said flat rectangular panels, the respective said first and second holes of each said seal plate aligned with the respective said hole of each said end of said channels, said channels increasing in the amount of overlap with the respective said hole of said seal plate with the increase in the distance of said channels from the center of their respective said hole.

15. The arrangement of claim 14, wherein said first holes of said first plate and said second holes of each said second plate are each circular, and said first and second holes of each said seal plate each comprise a rectangular portion overlapped by a said end of said channels and a semi-circular portion aligned with one of said first and second holes of said first and second plates.

16. The arrangement of claim 13, wherein said ends of said first channels and said ends of said second channels partially surround their respective said holes.

* * * * *